US010328443B2

(12) United States Patent
Ricketts et al.

(10) Patent No.: US 10,328,443 B2
(45) Date of Patent: Jun. 25, 2019

(54) CARTRIDGE FOR AN AEROSOL-GENERATING SYSTEM

(71) Applicant: Philip Morris Products S.A., Neuchatel (CH)

(72) Inventors: Nikolaus Martin Ernest Wilhelm Ricketts, Geneva (CH); Rui Nuno Batista, Morges (CH)

(73) Assignee: Philip Morris Products S.A., Neuchatel (CH)

( * ) Notice: Subject to any disclaimer, the term of this patent is extended or adjusted under 35 U.S.C. 154(b) by 0 days.

(21) Appl. No.: 15/578,850

(22) PCT Filed: Jun. 27, 2016

(86) PCT No.: PCT/EP2016/064887

§ 371 (c)(1),
(2) Date: Dec. 1, 2017

(87) PCT Pub. No.: WO2017/001352

PCT Pub. Date: Jan. 5, 2017

(65) Prior Publication Data

US 2018/0297048 A1 Oct. 18, 2018

(30) Foreign Application Priority Data

Jun. 29, 2015 (EP) ..... 15174397

(51) Int. Cl.
*A24F 47/00* (2006.01)
*B05B 11/00* (2006.01)
*B65D 51/28* (2006.01)

(52) U.S. Cl.
CPC ..... *B05B 11/0054* (2013.01); *A24F 47/008* (2013.01); *B05B 11/0081* (2013.01); *B65D 51/285* (2013.01)

(58) Field of Classification Search
None
See application file for complete search history.

(56) References Cited

U.S. PATENT DOCUMENTS

2008/0092912 A1 4/2008 Robinson et al.
2010/0200006 A1 8/2010 Robinson et al.
(Continued)

FOREIGN PATENT DOCUMENTS

EP 0 295 122 B1 1/1992
EP 1 754 419 A1 2/2007
(Continued)

OTHER PUBLICATIONS

International Search Report and Written Opinion dated Jan. 20, 2017 in PCT/EP2016/064887, filed Jun. 27, 2016.
(Continued)

*Primary Examiner* — Eric Yaary
(74) *Attorney, Agent, or Firm* — Oblon, McClelland, Maier & Neustadt, L.L.P.

(57) ABSTRACT

There is provided a cartridge for an aerosol-generating system, the cartridge including a liquid storage container containing: a first liquid composition and a second composition; a plurality of capsules, each capsule encapsulating the second composition to separate the second composition from the first liquid composition, each capsule including a frangible shell encapsulating the second composition; a capsule retainer; and an outlet in the liquid storage container configured to deliver liquid from the liquid storage container, the capsule retainer substantially preventing any frangible shells, or parts thereof, from exiting the cartridge through the outlet. An aerosol-generating device configured to receive the cartridge to form an aerosol-generating system is also provided.

13 Claims, 7 Drawing Sheets

(56) References Cited

U.S. PATENT DOCUMENTS

| | | | | |
|---|---|---|---|---|
| 2012/0060853 | A1 | 3/2012 | Robinson et al. | |
| 2012/0255567 | A1 | 10/2012 | Rose et al. | |
| 2013/0192620 | A1* | 8/2013 | Tucker ..... | H01C 17/00 131/329 |
| 2014/0000638 | A1 | 1/2014 | Sebastian et al. | |
| 2014/0060556 | A1 | 3/2014 | Liu | |
| 2014/0366898 | A1 | 12/2014 | Monsees et al. | |
| 2015/0027468 | A1 | 1/2015 | Li et al. | |
| 2015/0040930 | A1 | 2/2015 | Robinson et al. | |
| 2015/0047656 | A1 | 2/2015 | Robinson et al. | |
| 2015/0047662 | A1 | 2/2015 | Hopps | |
| 2016/0022930 | A1 | 1/2016 | Greim et al. | |

FOREIGN PATENT DOCUMENTS

| | | | |
|---|---|---|---|
| EP | 1 618 803 | B1 | 12/2008 |
| EP | 1 736 065 | B1 | 6/2009 |
| JP | 4188651 | B2 | 11/2008 |
| WO | WO 2011/034723 | A1 | 3/2011 |
| WO | WO 2014/140320 | A1 | 9/2014 |

OTHER PUBLICATIONS

Extended European Search Report dated Dec. 17, 2015 in Patent Application No. 15174397.8, citing documents AA-AC therein, 11 pages.

Richa Singh, "Peter Thomas Roth Mega Rich Body Wash Review", https://makeupandbeauty.com/peter-thomas-roth-mega-rich-body-wash-review/, 2013, 13 pages.

* cited by examiner

CARTRIDGE FOR AN AEROSOL-GENERATING SYSTEM

The present invention relates to a cartridge for an aerosol-generating system, and a device for receiving the cartridge.

A number of prior art documents, for example EP-A-0 295 122, EP-A-1 618 803 and EP-A-1 736 065, disclose electrically operated smoking systems, having a number of advantages. One advantage of some examples of such systems is that they can significantly reduce sidestream smoke, while permitting the smoker to selectively suspend and reinitiate smoking.

Prior art documents, such as EP-A-0 295 122, EP-A-1 618 803 and EP-A-1 736 065, disclose electrical smoking systems which use a liquid as the aerosol-forming substrate. The liquid may be contained in a cartridge which is receivable in a housing. A power supply, such as a battery, is provided, connected to a heater to heat the liquid substrate during a puff, to form the aerosol which is provided to the smoker.

In many cases, the liquid provided in the cartridges of the prior art is produced in advance of use, and transported as a pre-mixed composition.

There would be benefit from providing the user with a cartridge, and associated device, which enabled the liquid composition to be prepared, or completed, closer in time to the time of use, for example immediately prior to use.

According to a first aspect of the present invention, there is provided a cartridge for an aerosol-generating system. The cartridge comprises: a liquid storage container containing a first liquid composition, and a second composition separated from the first liquid composition; and an outlet in the liquid storage container for delivery of aerosol-forming substrate from the liquid storage container.

Preferably, the second aerosol-forming substrate is a liquid.

Advantageously, providing a cartridge having a first liquid composition and a second composition being separated therefrom, enables a composition to be mixed, blended, or chemically reacted, closer in time to the time of use, for example immediately prior to use, by enabling the compositions to interact at the time of use, for example when exiting the outlet, in an aerosol-generating system.

The cartridge preferably further comprises: a plurality of capsules, each capsule encapsulating the second composition to separate the second composition from the first liquid composition; and a capsule retainer. The capsules act to separate the first liquid composition from the second composition prior to use in an aerosol-generating system.

Each capsule preferably comprises a frangible shell encapsulating the second composition. Capsules which comprise such a frangible outer shell are preferably readily or easily broken, or ruptured, upon the use of mechanical force. The frangible outer shell of the capsules may be readily or easily disintegrated or dissolved, by changing the cohesion forces of the shell material, for example by the application of energy, such as heat or light.

Where the second composition is liquid, each capsule may be compressible, the outer shell encapsulating the liquid composition being formed from a porous material. The porous material is preferably flexible. The second composition, being a liquid, preferably passes through the porous shell when the shell is deformed to reduce the internal volume of the shell. The second liquid composition is preferably retained within the porous shell, until the shell is deformed, because of differences in surface tensions of the first liquid and the second liquid which ensure capillary forces do not transport the second liquid composition through the porous shell and into the first liquid composition.

The porous shell may have sorbed thereon the second liquid composition, or otherwise retain a third composition. The third composition may be a liquid, a gel or a solid. The third composition may be a liquid, a gel or a solid at room temperature, for example 21 degrees C. The composition retained on the porous shell may be released by deformation of the shell, or by increasing the temperature of the capsule by applying heat, or a combination of both deformation and increasing the temperature. By requiring the capsule to be heated before the composition can be released, the risk of the composition being released during transport, or storage, may be reduced.

Alternatively, the capsule may comprise a continuous porous material, such as a sphere of porous material, comprising the liquid composition. As will be appreciated, the liquid composition may be retained and released in a similar way to the capsule comprising a porous shell as described above.

The cartridge may comprise a plurality of capsules having a solid composition. The capsule may have a shell encapsulating the solid composition. The capsules having a solid composition may be frangible, such that they break-up into small fragments on application of compressive force.

The cartridge may comprise a plurality of sets of capsules, each set comprising a plurality of capsules. Each set may comprise any type of capsule as described herein, and each set may comprise the same or different gaseous, liquid or solid composition.

According to a second aspect of the present invention, there is provided a cartridge of aerosol-forming substrate for an aerosol-generating system. The cartridge comprises: a liquid storage container containing a first liquid composition and a plurality of capsules; an outlet in the liquid storage container for delivery of liquid composition from the liquid storage container; and a capsule retainer. Each capsule may comprise a frangible shell encapsulating a second composition. The capsule may be any capsule as described herein.

The second composition may be a liquid.

Advantageously, providing a cartridge having frangible capsules encapsulating a second composition and a corresponding capsule retainer enables a liquid composition to be mixed closer in time to the time of use, for example immediately prior to use, by deforming, rupturing or destroying the frangible shell, for example by crushing. The deformed, ruptured or destroyed frangible shell exposes the second composition to the first liquid composition enabling the two liquids to mix. The capsule retainer substantially prevents any frangible shells, or part thereof, from exiting the cartridge through the outlet.

The term "burst" is used herein to refer to the process of the capsule being deformed, ruptured or otherwise deformed to release the encapsulated composition. As used herein, the term "crush" is used to mean to press or squeeze with an external force.

Preferably, the frangible shell is substantially continuous. Preferably, the frangible shell is sealed before it is burst to release the second composition. Each capsule may be formed in a variety of physical formations including, but not limited to, a single-part capsule, a multi-part capsule, a single-walled capsule, a multi-walled capsule, a large capsule, and a small capsule.

Each capsule may be arranged to burst to release the second composition when the capsule is subjected to external force. The burst strength is the force (exerted on the capsule) at which the capsule will burst. The burst strength may be a peak in the capsule's force versus compression curve. Preferably, the frangible capsule has an average peak load at burst of between about 5 g and about 400 g. More preferably, the frangible capsule has an average peak load at burst of between about 7 g and about 100 g, yet more preferably between about 7 g and about 30 g. The relative deformation of the capsule as compared to the original dimension of the shell at peak load may be between about 1% to 25%, preferably between about 1% and about 15%, more preferably between about 1% and about 10%.

The capsule comprising a porous shell may have an average peak load to deform the capsule sufficiently such that the liquid composition is released of between about 5 g and about 100 g, preferably between about 5 g and about 50 g, more preferably between about 5 g and about 30 g. The relative deformation of the capsule as compared to the original dimension of the capsule at peak load may be between about 1% to 80%, preferably between about 1% and about 60%, more preferably between about 1% and about 50%.

The capsule comprising a solid composition may have an average peak load to break-up the capsule sufficiently such that the composition is released of between about 10 g and about 500 g, preferably between about 15 g and about 100 g, more preferably between about 20 g and about 50 g. The relative deformation of the capsule as compared to the original dimension of the capsule at peak load may be between about 1% to 30%, preferably between about 1% and about 20%, more preferably between about 1% and about 15%.

Each capsule may be arranged to burst to release the second composition when the capsule is subjected to sound, light, thermal, or chemical, energy.

Each capsule may be arranged to burst on receipt of ultrasonic sound, for example ultrasonic sound having a frequency between about 20,000 Hz and about 40,000 Hz, preferably between about 20,000 Hz and about 30,000 Hz. The decibel level of the ultrasonic sound is preferably less than about 7 dB, more preferably less than about 5 dB.

Each capsule may be arranged to burst on receipt of ultraviolet light, for example ultraviolet light having a wavelength of between about 100 nm and about 500 nm, preferably between about 200 nm and about 350 nm, and an intensity of about 2 $mW/cm^2$ and about 30 $mW/cm^2$, more preferably of about 5 $mW/cm^2$ to 15 $mW/cm^2$, yet more preferably of about 7 $mW/cm^2$ to 11 mW/cm2.

Each capsule may be arranged to burst on receipt of thermal energy which increases the temperature of the capsule to about 50 degrees C., or about 60 degrees C.

Each capsule may be arranged to burst when a chemical, for example an acid, is brought into contact with the frangible shell. The chemical may be released from other capsules in the liquid storage container. In this way a two stage process may be used to burst the capsules.

Each capsule may have any suitable shape, for example, spherical, spheroid, or ellipsoid. Preferably, however, each capsule is generally spherical. This may include capsules having a sphericity value of at least about 0.9, and preferably a sphericity value of approximately 1. Sphericity is a measure of how spherical an object is, with a perfect sphere having a sphericity value of 1. Sphericity values may be derived by determining the average of the largest diameter and the smallest diameter, deducting the difference between the largest diameter and the smallest diameter from the average, then dividing the result by that average.

The capsules may be manufactured according to any suitable method (for example, by co-extrusion, spheronisation, wet or dry granulation, or emulsification), as will be appreciated by those skilled in the art. The capsules may be formed from glycerine, parafin wax, silica or any other suitable material that will be appreciated by those skilled in the art.

The frangible capsules as described herein, may be formed of aqueous solutions of gelatine based formulations. For example, comprising plant polysaccharides including their derivatives such as carrageenan based materials, and gelling agents solutions such as glycerine as plasticizer. Gelling agents may also include starch and/or cellulose, or modified forms thereof. For the specific purpose of influencing the behaviour of the capsule inside a specific liquid, such as the first liquid aerosol-forming substrate, as well as the way the capsules will look and be easily perceived by the, the overall compound formulation for the hard shell may then include surface treatment or finishing agents, as well as non-uniform or uniform pigmentation including colouring agents. Preferably the compound formulation of the hard shell frangible capsules is cellulose based, preferably composed of hydroxypropyl methylcellulose (HPMC) in a form with low viscoelastic properties to achieve the desired burst strength specific ranges. As an example, formulations may include as core constituents: Vegesoft®, Pullulan and hypromellose, Glycerin, Sorbitol (incl. Sorbitol Special) and polyethylene (PEG) based fills.

The capsules comprising a porous shell, or being completely porous, can be formed of physical or chemical gels, in liquid or solid form, or in a combination of those forms. Preferably, the capsule is formed of physical gels with the same core composition based on aqueous solutions of gelling agents, as described for the hard shell frangible capsules. Specific formulations that enable a large range of elasticity and deformation are desirable, such as also using polyionic polymers, as well as including colloidal gels formulation. Such formulations may include soluble and insoluble matrix structures, and therefore may provide the desired physical characteristics while interfacing with the first liquid composition. The insoluble structure may include ion-exchange resin structures or ion-exchange polymers. Such structures may enable the enhancement of flavour and may improve chemical stability of active ingredients, as well as improving bioavailability of the given active ingredients in the first liquid composition and/or in the second composition that will be blended, mixed, or chemically reacting with the first liquid composition.

Such capsules with porous properties can be also made of a foam, namely an open cell foam, of the material as described above.

The capsules comprising a solid composition are preferably formed from solid gel particles which are coated with a material that creates the shell of such solid capsules. Such coated shell of the capsules can be made of the formulations described for frangible capsules, as once pressed the capsule shell will burst.

Each capsule may comprise a porous element having the second liquid composition sorbed thereon. The porous element may substantially fill the frangible shell, or may only fill a portion of the frangible shell.

The porous element may comprise one or more porous materials selected from the group consisting of porous plastic materials, porous polymer fibres and porous glass fibres. The one or more porous materials may or may not be capillary materials and are preferably inert with respect to the liquid aerosol-forming substrates. The particularly preferred porous material or materials will depend on the physical properties of the second liquid aerosol-forming substrate.

Suitable porous fibrous materials include, but are not limited to: cellulose cotton fibres, cellulose acetate fibres and bonded polyolefin fibres, such as a mixture of polypropylene and polyethylene fibres.

The capsules may all have substantially the same size, such as diameter where the capsules are substantially spherical. Where the capsules are substantially spherical, the diameter of each capsule may be between about 0.5 mm and about 4 mm, preferably between about 1 mm and about 3 mm, more preferably between about 1 mm and about 2 mm. The thickness of the frangible shell may be between about 5 μm and about 150 μm, more preferably between about 15 μm and about 80 μm. As will be appreciated by those skilled in the art, the thickness of the frangible shell will be one determining factor in the burst strength of the capsule.

The bulk density of each capsule is preferably substantially equal to the density of the liquid aerosol-forming substrate. In this way, the capsules are configured to be neutrally buoyant in the first liquid aerosol-forming substrate, and therefore may be distributed throughout the liquid storage container. As used herein, the term "bulk density" refers to the apparent density of the capsule and equals the total mass of the capsule, which is the mass of the frangible shell plus the mass of the material encapsulated in the shell which comprises at least the second composition, divided by the volume of the capsule. The bulk density can therefore be controlled by controlling the mass of the encapsulated material. For example, the volume of second composition can be adjusted, or the density of the second composition can be adjusted.

The cartridge may further comprise at least two sets of capsules, the first set comprising the plurality of capsules encapsulating the second composition, and the second set comprising a plurality of capsules comprising a frangible shell encapsulating a third composition. The cartridge may comprise further sets of capsules, each set of capsules comprising a further different composition.

The first set of capsules may be burstable by a first mechanism, and the second set of capsules may be burstable by a second mechanism. For example, the first set of capsules may be burstable by crushing, and the second set of capsules may be burstable by ultrasonic energy. In this way, the user may be able to control the composition of the mixed liquid composition by controlling which set of capsules are burst prior to use of the cartridge. For example, both the second composition and the third composition may be or may contain nicotine, the strength of the mixed liquid composition being controlled by the user bursting one or both of the first set and the second set of capsules.

The second composition and the third composition are preferably different to the first liquid composition, and are preferably different to each other. The second composition may have a different colour to the third composition.

The first liquid composition is preferably an aerosol-forming substrate. The aerosol-forming substrate preferably comprises at least an aerosol former and water. The aerosol former may be at least one of glycerine and propylene glycol.

The second and third compositions may comprise at least one of: nicotine; flavour; aroma; and aerosol-former. The flavour may be natural flavours, such as menthol, or artificial flavours.

The second and third compositions may be liquid, and may be any of the aerosol-forming substrates as described herein.

At least one of the liquid aerosol-forming substrates preferably comprises a tobacco-containing material containing volatile tobacco flavour compounds which are released from the substrate upon heating. At least one of the aerosol-forming substrates may comprise a non-tobacco material. At least one of the aerosol-forming substrates may comprise tobacco-containing material and non-tobacco containing material. Preferably, at least one of the aerosol-forming substrates further comprises an aerosol former.

The first liquid composition may have a first colour, or it may be substantially transparent. On mixing the first liquid with the second composition and/or where present the third composition, the mixture of the first liquid composition and the second composition may form a second colour, different from the first colour. In this way, the user is provided with a visual indication of when the liquids are fully mixed.

Where a second set of capsules is provided, the bulk density of each capsule in the second set of capsules may be different to the bulk density of each capsule in the first set of capsules. The bulk density of the first set of capsules may be different to the bulk density of the first liquid composition. In this way, the capsules may provide a visual indication of the temperature of the first liquid composition in a manner similar to a Galileo thermometer.

The cartridge may further comprise a set of capsules, each capsule having a bulk density less than the density of the first liquid composition and comprising a gas-permeable shell encapsulating a gas. The gas-permeable shell is configured such that after a pre-determined period of time, the bulk density of each capsule is greater than the density of the first liquid composition. In this way, the capsules encapsulating the gas can provide an indicator of the age of the cartridge. For example, the capsules sinking to the bottom of the liquid storage container may indicate that the cartridge has passed its use-by date.

The cartridge may further comprise a solid body freely movable within the liquid storage container. The solid body is configured to enable the user to mechanically agitate the cartridge and burst the capsules. The solid body may be spherical, cylindrical, cuboid, or any other suitable shape. After the capsules have been burst, the solid body may advantageously enable improved mixing, or blending of the first liquid composition and the second composition.

The liquid storage container may comprise a flexible wall. Where the liquid storage container comprises a flexible wall, the capsule retainer is preferably an adhesive for adhering the capsules to at least one wall of the liquid storage container. The flexible wall enables the capsules to be burst by crushing, the crushing force being applied to the flexible wall to deform the liquid storage container an exert a force on the capsules. By adhering the capsules to at least one wall of the liquid storage container, the capsules are retained in the liquid storage container, even after they have been burst. The flexible wall may be formed from a polymer such as a polymer described herein, or a mesh such as a stainless steel mesh over-moulded with a polymeric material, such as a polymeric material as described herein. The thickness of the flexible wall may be between about 0.1 mm and about 0.3 mm.

The capsule retainer may comprise a filter element. The filter element may be provided adjacent the outlet. The filter element may be fixed adjacent the outlet. The filter element is configured to strain the liquid composition of the capsules and parts thereof after they are burst to prevent the capsules or parts thereof from exiting the liquid storage container or to prevent them coming into contact with a particular region of the liquid storage container.

In some examples, the liquid may be dispensed from the liquid storage container into an aerosol-generating device for use. For example, the liquid may be dispensed from the cartridge into a liquid chamber of the aerosol-generating device. In some examples, the cartridge may be in the form of a bottle for storing the liquid. In some examples, the cartridge may form a liquid chamber of the aerosol-generating device. The cartridge may be a replaceable liquid bottle for use with the device and which is replaced once liquid in the liquid storage container has been used.

In the first aspect of the present invention, the liquid storage container may further comprise a partition defining a first compartment and a second compartment, for storing the first liquid aerosol-forming substrate separately from the second liquid aerosol-forming substrate respectively. The first compartment and the second compartment being in fluid communication. The partition may be a screen, mesh, or plate comprising a plurality of perforations. The partition may be a fluid permeable, or semi-fluid-permeable membrane. The membrane may be permeable to one or both of the first and second liquid aerosol-forming substrates. Preferably, the membrane is permeable to only one of the first and second liquid aerosol-forming substrates.

According to a third aspect of the present invention, there is provided a cartridge for an aerosol-generating system. The cartridge comprises: a liquid storage container comprising a partition defining a first compartment and a second compartment in the liquid storage container, the partition comprising a fluid permeable barrier between the first compartment and second compartment.

Preferably, the first compartment contains a first liquid composition, and the second compartment contains a second liquid composition, the first and second liquids being separated from each other by the partition. The cartridge of the third aspect preferably comprises an outlet in the liquid storage container for delivery of liquid composition from the liquid storage container.

The partition may be configured to define a first compartment having substantially the same volume as the second compartment, or different volumes. The partition may be provided perpendicular to the longitudinal axis of the liquid storage container, parallel to the longitudinal axis of the liquid storage container or oblique to the longitudinal axis of the liquid storage container.

In the first and third aspects, the second liquid composition may be separated from the first liquid composition by being dispersed in a gel.

In the first and third aspects, the second liquid composition may be delivered from the outlet at a different rate to the first liquid composition. For example, the second composition may be delivered at a slower rate. In this way, the mix of the first composition and the second composition may be controlled to produce a desired further, final, composition for aeroslisation by an aerosol-generating device.

The filter element may be movable between a first position adjacent the outlet to a second position remote from the first position. The action of moving the filter element from the first position to the second position preferably exerts sufficient force on the capsules to burst them, releasing the second composition.

The liquid storage container preferably has a circular cross-section. Preferably, the outer diameter of the filter element is such that the filter element is a close sliding fit within the liquid storage container. Arranging the liquid storage container and the filter element such that there is a close sliding fit improves the filtering to reduce or eliminate the presence of capsules, or parts thereof, in the bulk of the liquid aerosol-forming substrate when the filter element is in the second position. The filter element may comprise a seal, such as an o-ring, configured to slide against the inner surface of the liquid storage container.

The filter element may be configured to receive an end of a liquid transport element received by the outlet, wherein in use, the liquid transport element acts on the filter element to move the filter element from the first position to the second position.

The filter element may comprise a through hole configured to receive the end of a liquid transport element. The filter element preferably comprises a porous disc having a recess, and a filter disposed in the recess. The thickness of the porous disc is preferably configured such that the porous disc remains substantially perpendicular to a longitudinal axis of the liquid storage container as the filter element moves from the first position to the second position. The thickness of the porous disc may be between about 50 μm and about 400 μm, preferably between about 70 μm and about 200 μm. The porous disc preferably comprises the through hole. The porous disc may comprise a plurality of perforations. The porous disc may comprise a mesh, preferably a coarse mesh. The porous disc may be moulded from a polymer, such as any of the polymers suitable for forming the canister described above. On receipt of a liquid transport element in the through hole, the filter is preferably configured such that the liquid transport element engages with the filter. The inner diameter of the through hole is preferably such that the liquid transport element is an interference fit within the porous disc.

The filter may comprise capillary fibres. The filter may be formed by welding a mat of capillary fibres. The welding may be ultrasonic welding. The filter may have a thickness between about 20 μm and about 200 μm, preferably between about 20 μm and about 100 μm.

Where a movable filter is provided, the cartridge may further comprise a liquid transport element coupled to the filter element, the liquid transport element extending through the outlet. The liquid transport element may be used as a plunger by the user to move the filter element from the first position to the second position to burst the capsules. In the second position, the capsules, or parts thereof, are separated from the bulk of the liquid and distant from the outlet. The liquid transport element is preferably an elongate shaft, and is preferably substantially rigid. When the filter element is in the first position, the liquid transport element coupled to the filter element is in a first position. When the filter element is in the second position, the liquid transport element coupled thereto is in a second position. The cartridge may further comprise a seal between the outlet and the liquid transport element, the seal being broken on movement of the liquid transport element to move the filter element from the first position to the second position.

The cartridge preferably further comprises a seal configured to seal the outlet. The seal may be frangible. The seal may be removable. The seal may be formed from a film. The film may be formed of a metal film, preferably aluminium, more preferably food grade, anodised aluminium, or a polymer such as polypropylene, polyurethane, polyethylene, fluorinated ethylene propylene.

The seal may be formed from a laminate film. At least one layer of the laminate material may be paper or cardboard. The layers of the laminate may be bonded together using adhesive, heat, or pressure. When the laminate comprises a layer of aluminium and a layer of polymer material, the polymer material may be a coating. The coating layer may be thinner than the aluminium layer. When the cartridge comprises a frangible seal, the first portion of the liquid transport element may comprise a piercing portion configured to pierce the seal. The first portion of the liquid transport element may comprise at least one ridge, configured to engage with the filter element.

The liquid storage container may comprise a canister having a closed end and an open end, and a lid comprising the outlet. The canister may comprise a lip, and the lid may comprise a projection, the lip and projection are configured to engage to fix the lid to the canister. The liquid storage container may be a thin-walled canister. The canister may be formed from a substantially transparent material, such as ALTUGLAS® Medical Resins Polymethlymethacrylate (PMMA), Chevron Phillips K-Resin® Styrene-butadiene copolymer (SBC), Arkema special performance polymers Pebax®, Rilsan®, and Rilsan® Clear, DOW (Health+™) Low-Density Polyethylene (LDPE), DOW™ LDPE 91003, DOW™ LDPE 91020 (MFI 2.0; density 923), ExxonMobil™ Polypropylene (PP) PP1013H1, PP1014H1 and PP9074MED, Trinseo CALIBRE™ Polycarbonate (PC) 2060-SERIES. The canister may be moulded, such as by in an injection moulding process.

The internal diameter of the orifice is preferably such that there is a close sliding fit between the orifice and the liquid transport element. Therefore, when the liquid transport element is in the second position, resistance to liquid leakage between the external surface of the liquid transport element and the orifice is improved. The internal diameter of the orifice may be between about 1.8 mm and about 7 mm, preferably between about 2.2 mm and about 5 mm, more preferably between about 2.1 mm and about 2.8 mm. The external diameter of the liquid transport element may be between about 1.5 mm and about 7 Mm, preferably between about 2 mm and about 5 mm, more preferably about 1.8 mm and about 2.3 mm. The tolerance between the internal diameter of the outlet and the external diameter of the liquid transport element is preferably between about 0.05 mm and about 0.3 mm, preferably 0.1 mm and about 0.15 mm.

The orifice may comprise a flexible gasket configured to deform on receipt of the liquid transport element in the orifice. Such a flexible gasket improves the resistance to leakage between the external surface of the liquid transport element and the orifice. The flexible gasket may be an elastomer or a polymer, such as graphene.

Where the cartridge comprises a liquid transport element, the cartridge may further comprise a protective sheath, coupled to the liquid transport element and configured to slidably engage with the liquid storage container of the cartridge. The protective sheath advantageously protects the liquid transport element from damage, or contamination, when the liquid transport element is in the first position. The protective sheath is preferably cylindrical having an open end and a closed end, the internal diameter of the cylinder being such that a close sliding fit is provided between the internal surface of the sheath and the external surface of the liquid storage container.

The liquid transport element may further comprise at least one heating element adjacent the second portion of the liquid transport element. The at least one heating element preferably comprises electrical contacts configured to enable an electrical connection to be made to a power supply. Further details of the at least one heating element are provided below. Where a protective sheath is provided, the second portion of the liquid transport element comprising the at least one heating element may protrude through the closed end of the sheath.

The liquid transport element may comprise a capillary wick. The capillary wick may be formed from capillary fibres, including glass fibres, carbon fibres, and metallic fibres, or a combination of any and all of glass fibres, carbon fibres and metallic fibres. Providing metallic fibres may enhance the mechanical resistance of the wick without negatively affecting the hydrophobic properties of the overall wick. Such fibres may be provided parallel to the central axis of the wick, and may be braided, twisted or partially non-woven. Preferably, when the liquid transport element is in the second position, the capillary wick is arranged to be in contact with liquid in the liquid storage container. In that case, in use, liquid is transferred from the liquid storage container towards the at least one electric heating element by capillary action in the capillary wick. When the heating element is activated, liquid in the capillary wick is vaporised by the heating element to form the supersaturated vapour. The supersaturated vapour is mixed with and carried in the airflow. During the flow, the vapour condenses to form the aerosol and the aerosol is carried towards the mouth of a user. The heating element in combination with a capillary wick may provide a fast response, because that arrangement may provide a high surface area of liquid to the heating element. Control of the heating element according to the invention may therefore depend on the structure of the capillary wick or other heating arrangement. Further detail regarding the heating element and the control thereof is provided below.

An advantage of providing a cartridge is that a high level of hygiene can be maintained. Using a liquid transport element, such as a capillary wick, extending between the liquid and the electric heating element, allows the structure of the device to be relatively simple. The liquid has physical properties, including viscosity and surface tension, which allow the liquid to be transported through the liquid transport element, such as by capillary action. The cartridge is preferably not be refillable. Thus, when the liquid in the liquid storage container has been used up, the aerosol generating device is replaced. Preferably, the liquid storage container is arranged to hold liquid for a pre-determined number of puffs.

Where the liquid transport element comprises a capillary wick, the capillary wick may have a fibrous or spongy structure. The capillary wick preferably comprises a bundle of capillaries. For example, the capillary wick may comprise a plurality of fibres or threads, or other fine bore tubes. The fibres or threads may be generally aligned in the longitudinal direction of the aerosol generating device. The capillary wick may comprise sponge-like or foam-like material formed into a rod shape. The structure of the wick forms a plurality of small bores or tubes, through which the liquid can be transported to the at least one heating element, by capillary action. The capillary wick may comprise any suitable material or combination of materials. Examples of suitable materials are ceramic- or graphite-based materials in the form of fibres or sintered powders. The capillary wick may have any suitable capillarity and porosity so as to be used with different liquid physical properties such as density, viscosity, surface tension and vapour pressure. The capillary properties of the wick, combined with the properties of the liquid, ensure that the wick is always wet in the heating area.

The liquid transport element may further comprise a conduit having a first end and a second end. The conduit is configured such that, when the liquid transport element is in the first position, the first end and the second end of the conduit are external to the liquid storage container, and, when the liquid transport element is in the second position, the first end of the conduit is internal to the liquid storage container, and the second end of the conduit is external to the liquid storage container. When the liquid transport element is in the second position, the conduit is preferably configured to transport liquid from within the liquid storage container to without the liquid storage container. The conduit may be hollow. The conduit may comprise capillary material.

According to a fourth aspect of the present invention, there is provided an aerosol-generating device configured to receive a cartridge having a liquid transport element and heating element as described herein. The device comprises: a housing for receiving the cartridge; a power supply; and electrical contacts configured to couple the heating element of the cartridge to the power supply when the cartridge is received in the device.

Preferably, the housing comprises a cavity for receiving the cartridge.

The device of the fourth aspect may further comprise an actuator configured to move the liquid transport element from the first position to the second position when the cartridge is received in the cavity. The actuator may be an electrically operated actuator. The electrically operated actuator may be actuated when a cartridge is received in the cavity of the housing. The actuator may be a mechanically operated actuator. The mechanically operated actuator may be user operated. The housing may comprise a lid configured to close the cavity. The lid may be a hinged lid configured to move from a first, open, position to a second, closed position. In the first position, the cartridge may be inserted into the cavity. Where present, the mechanically operated actuator may be coupled to the lid. The action of closing the lid may operate the mechanical actuator to move the liquid transport element from the first position to the second position. The actuator preferably engages the electrical contacts of the device with corresponding electrical contacts on the cartridge to enable power to be supplied to the at least one heater of the cartridge.

Alternatively to providing an actuator, the user may apply a longitudinal compressive force to the cartridge to move the liquid transport element from the first position to the second position, and then insert the cartridge into the device.

According to a fifth aspect of the present invention, there is provided an aerosol-generating device configured to receive a cartridge without a liquid transport element as described herein. The device comprises: a housing having a cavity for receiving the cartridge; a liquid transport element comprising a first portion insertable into the outlet of the cartridge, and a second portion; a heating element adjacent the second portion of the liquid transport element; and a power supply configured to supply power to the heating element.

The device of the fifth aspect may further comprise an actuator configured to engage the cartridge with the liquid transport element when the cartridge is received in the cavity, such that the liquid transport element is inserted into the cartridge. The actuator may be an electrically operated actuator. The electrically operated actuator may be actuated when a cartridge is received in the cavity of the housing. The actuator may be a mechanically operated actuator. The mechanically operated actuator may be user operated. The housing may comprise a lid configured to close the cavity. The lid may be a hinged lid configured to move from a first, open, position to a second, closed position. In the first position, the cartridge may be inserted into the cavity. Where present, the mechanically operated actuator may be coupled to the lid. The action of closing the lid may operate the mechanical actuator to move the cartridge towards the liquid transport element such that the liquid transport element is moved into the cartridge from the first position to the second position.

The device of the fifth aspect preferably further comprises a shield movable from a first position to a second position, wherein in the first position the shield is adjacent the first portion of the liquid transport element, and in the second position the shield is adjacent the second portion of the liquid transport element, wherein the shield is biased towards the first position. The shield advantageously protects the liquid transport element from damage of contamination before a cartridge is inserted into the cavity.

The device of the fourth and fifth aspects may further comprise a capsule rupturing device, the device being at least one of: an ultrasonic generator; an ultraviolet light; an electrical heater; and a crusher.

The ultrasonic generator is preferably configured to emit ultrasonic sound having a frequency between about 20,000 Hz and about 40,000 Hz, preferably between about 20,000 Hz and about 30,000 Hz, and a decibel level less than about 7 dB, preferably less than about 5 dB. The ultrasonic generator may be activated by the user, for example using a switch, or automatically be the device, for example on insertion of the cartridge.

The ultraviolet light is preferably configured to emit light having a wavelength of between about 100 nm and about 500 nm, preferably between about 200 nm and about 350 nm, and an intensity of about 2 $mW/cm^2$ and about 30 $mW/cm^2$, more preferably of about 5 $mW/cm^2$ to 15 $mW/cm^2$, yet more preferably of about 7 $mW/cm^2$ to 11 mW/cm2. The light may be activated by the user, for example using a switch, or automatically be the device, for example on insertion of the cartridge.

To enable the capsule to be burst by ultraviolet light, the capsule preferably comprises a coating for UV light-induced triggering of the bursting process. The coating may be a photosensitive functional self-immolative polymer such as a light-sensitive self-immolative polymer containing a quinone methide backbone and photocleavable nitrobenzyl alcohol as the triggers. Also UV light-induced release can be obtained using polyorganosiloxane particles with nitrocinnamate in the formulation of the capsule shells, which physically degrade when exposed to UV. Self-degradation of the capsule shells when exposed to light, including UV light, can be also obtained using photodegradable polyesters synthesized with a photolabile monomer 2-nitrophenylethylene glycol and dioyl chlorides.

The electrical heater may be disposed in the cavity for receiving the cartridge. The electrical heater is preferably configured to heat the cartridge to at least 50 degrees C., preferably less than 60 degrees C., which is sufficient to burst the capsules sensitive to heat, as described above.

The crusher may be an electrical actuator configured to exert a force on the cartridge to compress the liquid storage container and burst the capsules.

As described above, the cartridge may comprise a first set of capsules and a second set of capsules, each set being sensitive to a different mechanism for bursting the frangible shells. In this case, the device may comprise means for bursting each set of capsules. The device may comprise an input for receiving an input form the user indicating which of the capsules should be burst. On receipt of the input, the device activates the corresponding bursting means.

The device preferably comprises a mouthpiece. As used herein, the term "mouthpiece" preferably refers to a portion of an aerosol-generating system, an aerosol-generating article, or the aerosol-generating device, that is placed into a user's mouth in order to directly inhale an aerosol generated by the aerosol-generating system. The mouthpiece may be removable. The mouthpiece may comprise a lid for closing the cavity.

The aerosol-generating device may comprise an aerosol-forming chamber in which aerosol forms from a super saturated vapour, which aerosol is then carried into the mouth of a user. An air inlet, air outlet and the chamber are preferably arranged so as to define an airflow route from the air inlet to the air outlet via the aerosol-forming chamber, so as to convey the aerosol to the air outlet and into the mouth of a user. In use, the second portion of the liquid transport element is preferably disposed within the aerosol-forming chamber. The air inlet may be provided in a mouthpiece. The air outlet may be provided in the mouthpiece. A portion of the cavity for receiving the cartridge may form the aerosol-forming chamber. The airflow path may extend from the air inlet, through the aerosol-forming chamber, around the cartridge, and to the air outlet.

The mouthpiece may be formed from medical adequate polymeric compounds, including grade polymers, including using DuPont™ Delrin® acetal and Zytel® nylon resins, as well as Altuglas® PMMA, Celanex® PBT, ExxonMobil™ PP—Medical Grades, Fortron® PPS, Hostaform® POM, K-Resin® SBC, LD PE Health+™ Dow, Pebax® TPE-A, Riteflex® TPE-E, Vectra® LCP. The mouthpiece may comprise a coating, such as a polymeric coating.

The device housing, preferably the outer body, may comprise the part that is held by the user. The device housing may comprise a coating, preferably the coating is the same as the coating, where provided, on the mouthpiece.

The device may comprise more than one heating element, for example two, or three, or four, or five, or six or more heating elements. The heating element or heating elements may be arranged appropriately so as to most effectively heat the aerosol-forming substrate.

The at least one electric heating element preferably comprises an electrically resistive material. Suitable electrically resistive materials include but are not limited to: semiconductors such as doped ceramics, electrically "conductive" ceramics (such as, for example, molybdenum disilicide), carbon, graphite, metals, metal alloys and composite materials made of a ceramic material and a metallic material. Such composite materials may comprise doped or undoped ceramics. Examples of suitable doped ceramics include doped silicon carbides. Examples of suitable metals include titanium, zirconium, tantalum and metals from the platinum group. Examples of suitable metal alloys include stainless steel, Constantan, nickel-, cobalt-, chromium-, aluminium-titanium- zirconium-, hafnium-, niobium-, molybdenum-, tantalum-, tungsten-, tin-, gallium-, manganese- and iron-containing alloys, and super-alloys based on nickel, iron, cobalt, stainless steel, Timetal®, iron-aluminium based alloys and iron-manganese-aluminium based alloys. Timetal® is a registered trade mark of Titanium Metals Corporation, 1999 Broadway Suite 4300, Denver Colo. In composite materials, the electrically resistive material may optionally be embedded in, encapsulated or coated with an insulating material or vice-versa, depending on the kinetics of energy transfer and the external physicochemical properties required. The heating element may comprise a metallic etched foil insulated between two layers of an inert material. In that case, the inert material may comprise Kapton®, all-polyimide or mica foil. Kapton® is a registered trade mark of E.I. du Pont de Nemours and Company, 1007 Market Street, Wilmington, Del. 19898, United States of America.

The at least one electric heating element may comprise an infra-red heating element, a photonic source, or an inductive heating element.

The at least one electric heating element may take any suitable form. The at least one electric heating element may take the form of a casing or substrate having different electro-conductive portions, or an electrically resistive metallic tube. The cartridge may incorporate a disposable heating element. The at least one electric heating element may be a disk (end) heating element or a combination of a disk heating element with heating needles or rods. The at least one electric heating element may comprise a flexible sheet of material arranged to surround or partially surround the aerosol-forming substrate. Other possibilities include a heating wire or filament, for example a Ni—Cr, platinum, tungsten or alloy wire, or a heating plate. Optionally, the heating element may be deposited in or on a rigid carrier material.

The at least one electric heating element may comprise a heat sink, or heat reservoir comprising a material capable of absorbing and storing heat and subsequently releasing the heat over time to the aerosol-forming substrate. The heat sink may be formed of any suitable material, such as a suitable metal or ceramic material. Preferably, the material has a high heat capacity (sensible heat storage material), or is a material capable of absorbing and subsequently releasing heat via a reversible process, such as a high temperature phase change. Suitable heat storage materials include silica gel, alumina, carbon, glass mat, glass fibre, minerals, a metal or alloy such as aluminium, silver or lead, and a cellulose material such as paper. Other materials which release heat via a reversible phase change include paraffin, sodium acetate, naphthalene, wax, polyethylene oxide, a metal, metal salt, a mixture of eutectic salts or an alloy.

The heat sink or heat reservoir may be arranged such that it is directly in contact with the aerosol-forming substrate and can transfer the stored heat directly to the substrate. The heat stored in the heat sink or heat reservoir may be transferred to the aerosol-forming substrate by means of a heat conductor, such as a metallic tube.

The at least one heating element may heat the aerosol-forming substrate by conduction. The heating element may be at least partially in contact with the substrate, or the carrier on which the substrate is deposited. The heat from the heating element may be conducted to the substrate by a heat conductive element.

The at least one heating element may transfer heat to the incoming ambient air that is drawn through the electrically heated aerosol generating device during use, which in turn heats the aerosol-forming substrate by convection. The ambient air may be first drawn through the substrate and then heated.

Control of the at least one electric heating element may depend upon the physical properties of the liquid substrate, such as the boiling point, vapour pressure, and surface tension.

The device may comprise control circuitry configured to control the supply of power from the power supply to the or each heating element. The control circuitry may comprise a puff sensor configured to detect when a user draws on the device, the control circuitry activates the heater when a puff is detected. The device may comprise a user input, such as a switch, for activating the device.

The power supply may be an external electric power supply or an on-board electric power supply. The power supply may be AC or DC, preferably DC. The power supply may be a battery. The power supply may alternatively be another form of charge storage device such as a capacitor. The power supply may require recharging and may have a capacity that allows for the storage of enough energy for one or more smoking experiences; for example, the power supply may have sufficient capacity to allow for the continuous generation of aerosol for a period of around six minutes, corresponding to the typical time taken to smoke a conventional cigarette, or for a period that is a multiple of six minutes; in another example, the power supply may have sufficient capacity to allow for a predetermined number of puffs or discrete activations of the heater.

Preferably, the aerosol generating device is portable. The aerosol generating device may be a smoking device and may have a size comparable to a conventional cigar or cigarette. The smoking device may have a total length between approximately 30 mm and approximately 150 mm. The smoking device may have an external diameter between approximately 5 mm and approximately 30 mm.

According to a yet further aspect of the invention there is provided an aerosol-forming composition comprising a liquid aerosol-forming substrate and a plurality of capsules, wherein each capsule comprises a shell encapsulating a composition. The shell may for example be a frangible shell. The frangible shell may for example be breakable on application of a pressing force. The composition within the capsule may comprise a further aerosol-forming substrate. The aerosol-forming composition may be for use in a smoking device. The aerosol-forming composition may for example comprise nicotine. The capsule composition may for example comprise nicotine.

According to a still further aspect of the present invention, there is provided an electrically heated aerosol-generating system comprising a cartridge as described herein, and an aerosol-generating device as described herein.

Any feature in one aspect of the invention may be applied to other aspects of the invention, in any appropriate combination. In particular, method aspects may be applied to apparatus aspects, and vice versa. Furthermore, any, some or all features in one aspect can be applied to any, some or all features in any other aspect, in any appropriate combination.

It should also be appreciated that particular combinations of the various features described and defined in any aspects of the invention can be implemented and/or supplied and/or used independently.

The disclosure extends to methods and apparatus substantially as herein described with reference to the accompanying drawings.

The invention will be further described, by way of example only, with reference to the accompanying drawings in which.

Figure 3:
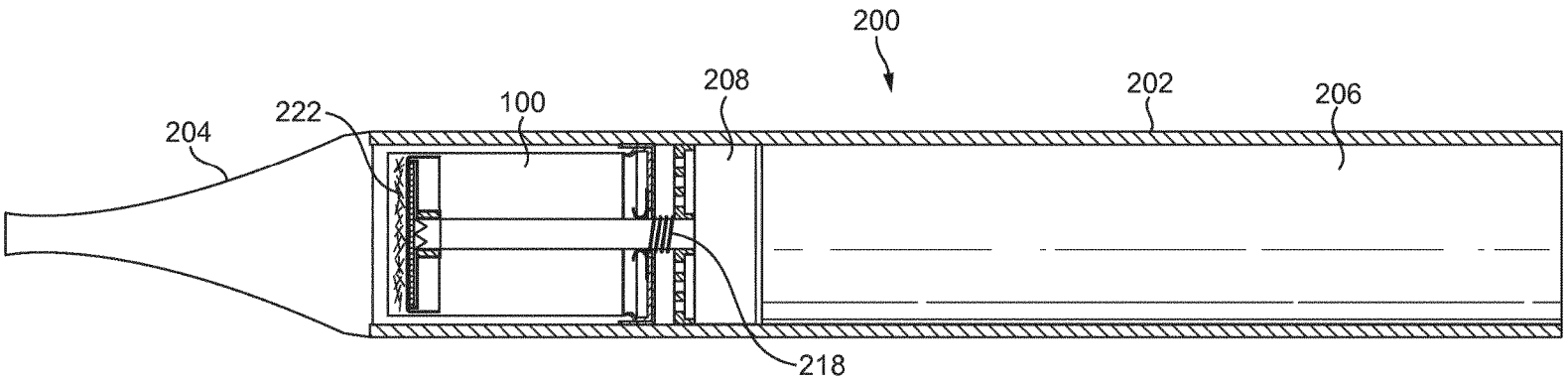
FIG. 3 shows a system comprising the aerosol-generating device of FIG. 2 with the cartridge of FIG. 1.
Figure 4A:
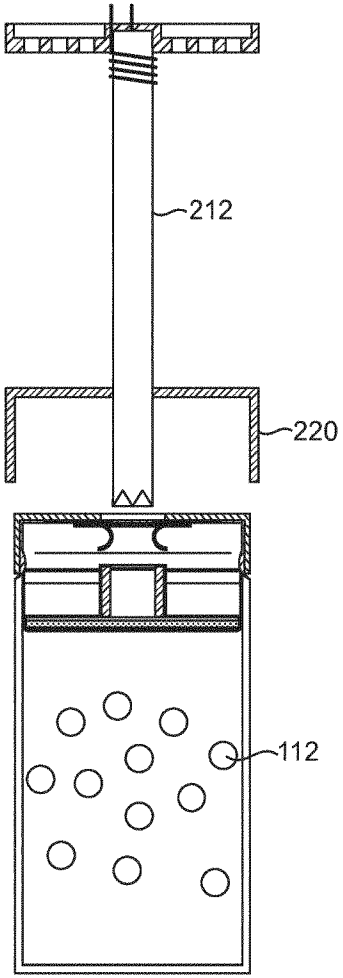
Figure 4B:
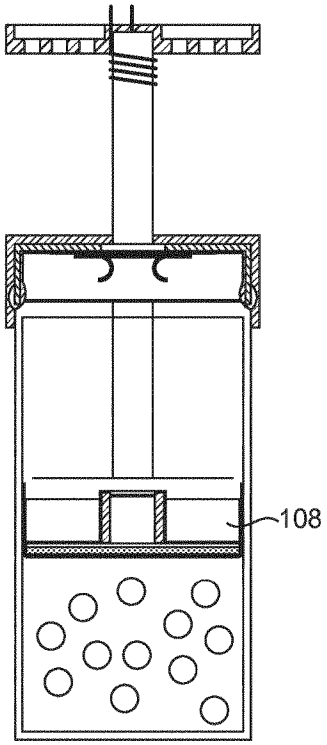
Figure 4C:
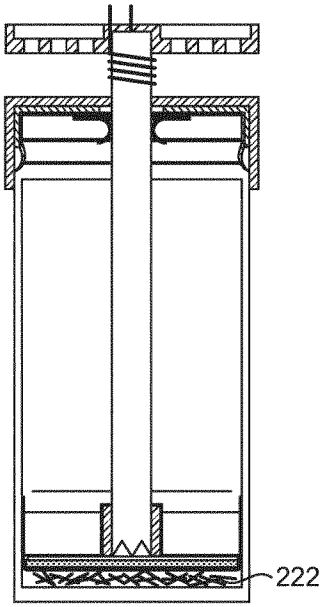
Figure 5A:
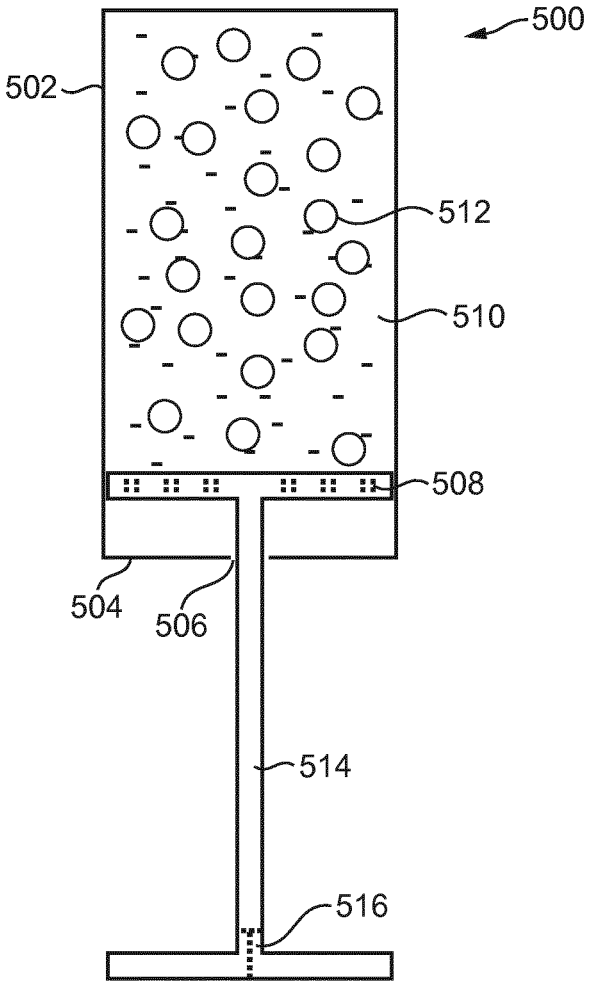
Figure 5B:
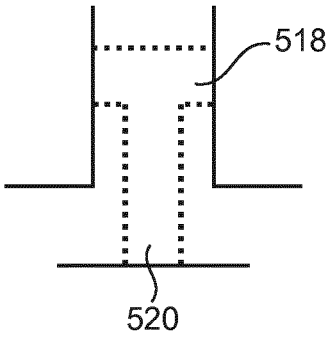
Figure 6:
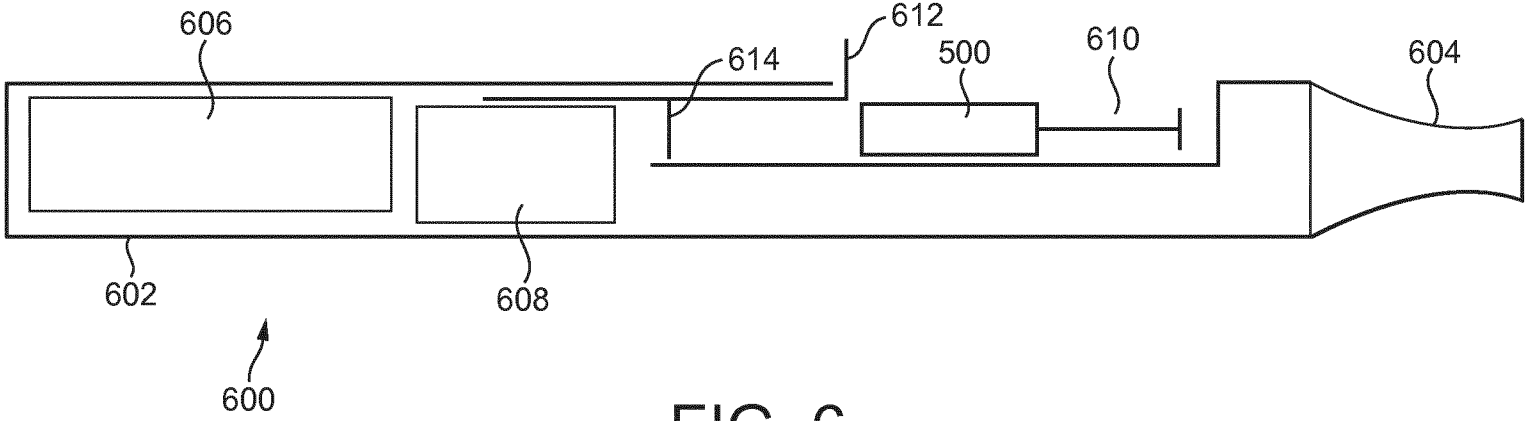
Figure 7:
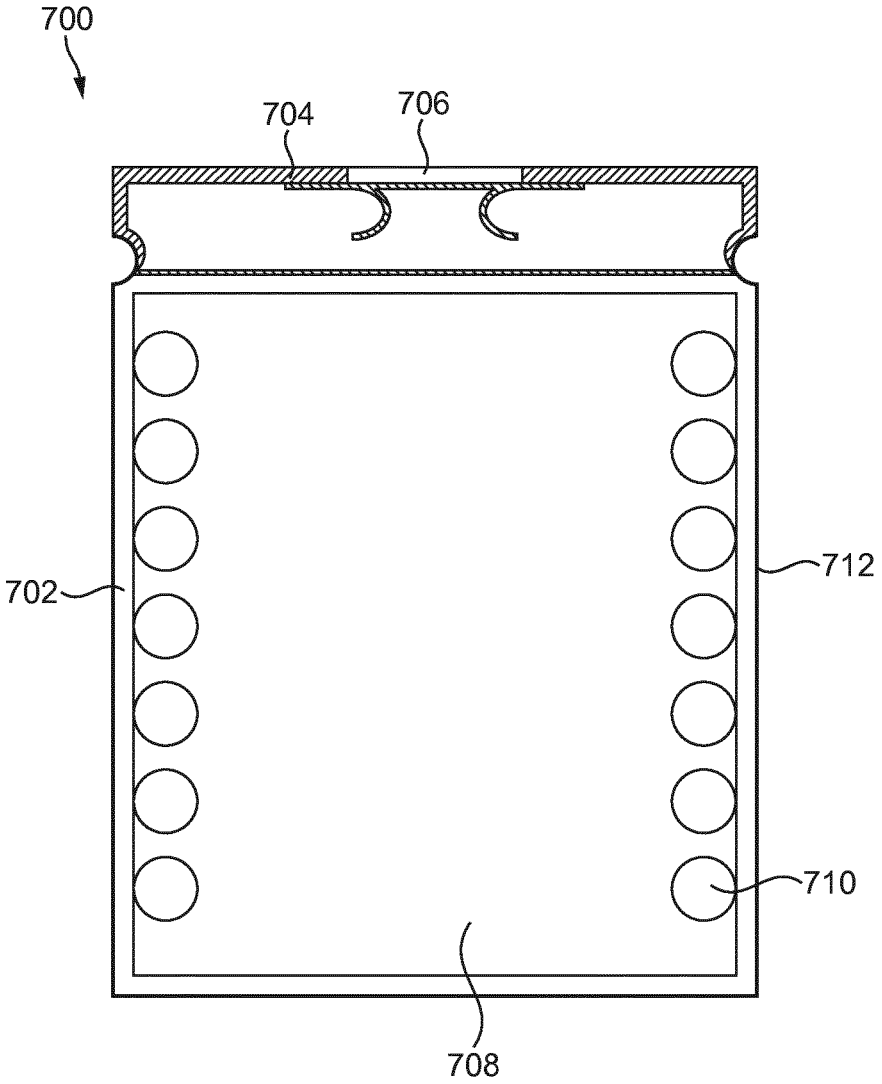
Figure 8:
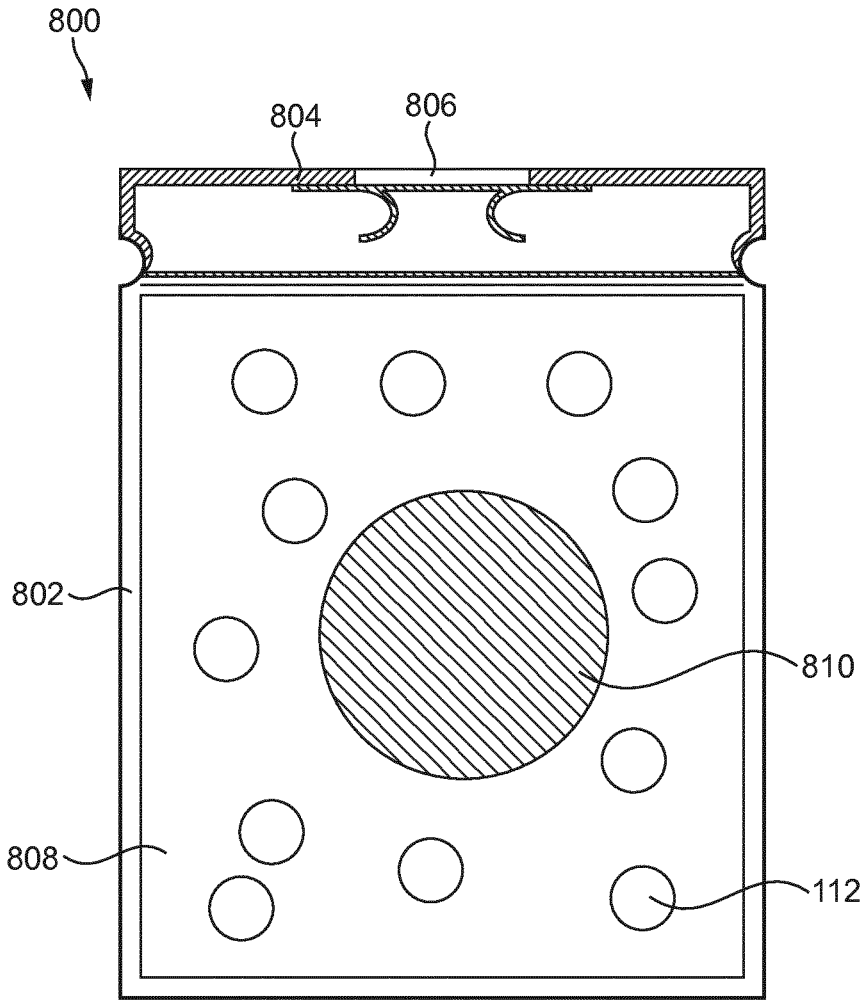

FIGS. 4(*a*), 4(*b*), and 4(*c*) show the system of FIG. 3 in use;

FIG. 5 shows a cartridge according to an alternative embodiment of the present invention;

FIG. 6 shows an aerosol-generating device according to an alternative embodiment of the present invention;

FIG. 7 shows a cartridge according to an alternative embodiment of the present invention; and FIG. 8 shows a cartridge according to a further alternative embodiment of the present invention.

Figure 1:
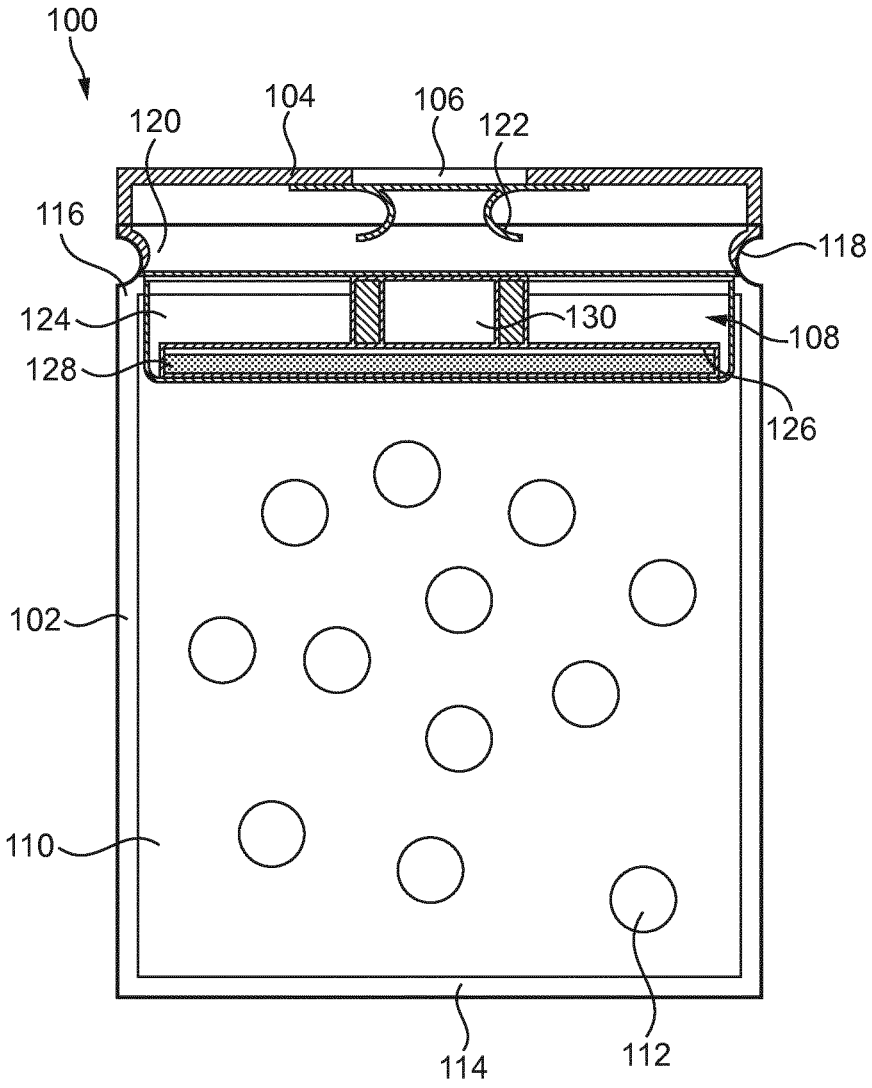
FIG. 1 shows a cartridge according to one embodiment of the present invention.

FIG. 1 shows a cartridge 100, comprising a liquid storage container in the form of canister 102, a lid 104 having an orifice 106, and a filter element 108. The canister 102 comprises a liquid aerosol-forming substrate 110 having a plurality of capsules 112. The liquid aerosol-generating substrate comprises an aerosol former, such as glycerine and propylene glycol and water, which are released from the aerosol-forming substrate upon heating. The capsules 112 comprise a frangible shell encapsulating a second liquid aerosol-forming substrate comprising, for example, nicotine. The frangible shell may be formed from glycerine or a similar material, preferably glycerine which is solid up to about 50 degrees C.

The canister 102 is cylindrical and has a closed end 114 and an open end 116. The canister is sealed by the lid 104, and a frangible film disposed over the orifice 106. The lid comprises a protrusion 118 around the circumference of the lid which engages with a corresponding lip 120 adjacent the open end of the canister. The lid further comprises a flexible gasket 122 configured to received a liquid transport element, which is described in further detail below.

The canister 102 may be substantially transparent to allow the user to view the contents of the cartridge 100.

The filter element 108 comprises a porous disc 124 and a filter 126. The porous disc 124 comprises a porous base 128 in the form of a coarse mesh. The filter 126 is formed of capillary fibres which are ultrasonically welded together. The filter is affixed to the underside of the porous base 128. The porous disc 124 further comprises a through hole 130 configured to receive a liquid transport element.

In use, the filter element is configured to be movable to burst the capsules and strain the resultant frangible shell material from the liquid, and move the resultant frangible shell material away from the orifice 106.

As can be seen, the filter element 108 has an external diameter such that a close sliding fit is provided in the canister 102. In this way, the capsules are prevented from passing around the filter element as the filter element moves along the canister. The thickness of the porous disc 124 is such that the disc remains substantially perpendicular to the longitudinal axis of the cartridge as it moves from the position shown in FIG. 1, the first position, to a position adjacent the closed end 114, the second position.

Such a cartridge enables the nicotine containing liquid to remain separate from the other components of the liquid aerosol-forming substrate in the main portion of the liquid storage container until just before use in an aerosol-generating device. Once the capsules have been burst the two liquid aerosol-forming substrates mix to form the composition to be aerosolised by an aerosol-generating device.

Figure 2:
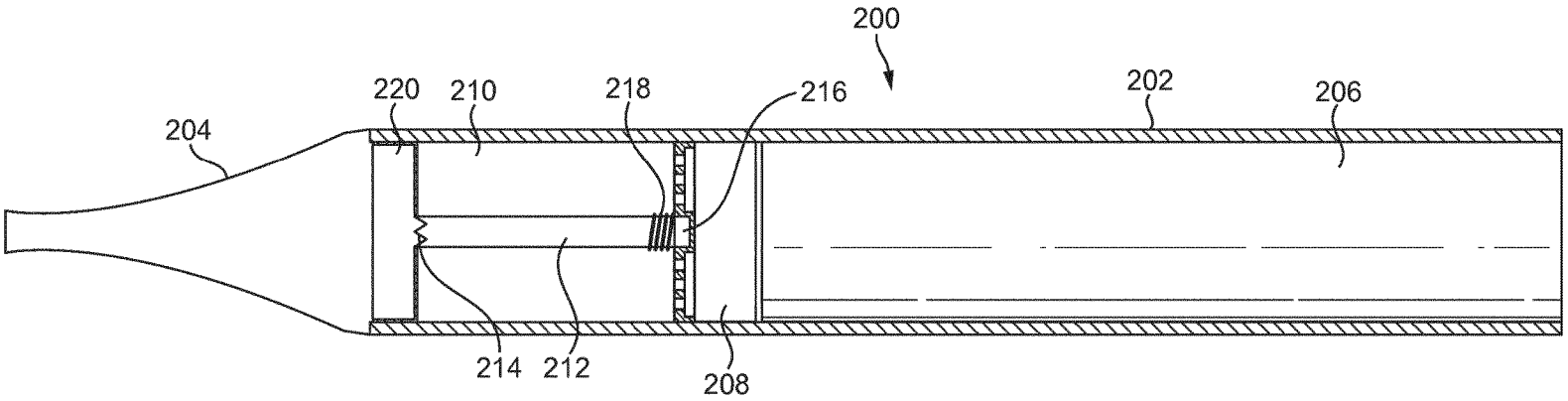
FIG. 2 shows an aerosol-generating device according to one embodiment of the present invention.

FIG. 2 shows an aerosol-generating device 200 configured to receive and use the cartridge 100. The device 200 comprises an outer housing 202, a removable mouthpiece 204, a power supply 206 in the form of a rechargeable battery, control circuitry 208, and a cavity 210 configured to receive a cartridge 100. The cavity 210 comprises a liquid transport element 212 having a first, free, end 214 and a second end 216 attached to the device 200. The liquid transport element 212 comprises a resistive heating element 218 adjacent the second end 216. The heating element 218 is electrically coupled to the power supply 206 via the control circuitry 208. The first end 214 of the liquid transport element 212 comprises ridges configured to both pierce the frangible seal on the cartridge 100, and to engage with the filter 126. The liquid transport element 212 is a capillary wick for transporting liquid from the canister 102 of a cartridge 100 to the heating element 218.

The cavity further comprises a shield 220. The shield is biased, for example by a spring, towards the mouthpiece end of the device, and is configured to slide over the liquid transport element 212. The shield protects the liquid transport element 212 from damage and contamination when the device is not in use. An air inlet (not shown), and an air outlet in the mouthpiece (not shown) are provided, together with an airflow pathway which extends from the air inlet to the air outlet via the cavity.

FIG. 3 shows the device 200 with a cartridge 100 inserted in the cavity 210. FIGS. 4(*a*), 4(*b*) and 4(*c*) show the process of the user inserting the cartridge 100 into the device 200. In use, the user removes the mouthpiece 204 to open the cavity 210. The user then inserts the cartridge 100 into the cavity 210. The cartridge engages with the shield 220 which guides the cartridge 100 such that the liquid transport element 212 first pierces the frangible seal, and then moves through the flexible gasket 122, and engages with the through hole 130 of the porous disc 124. As the cartridge 100 is inserted further into the cavity, the liquid transport element 212 moves the filter element 108 from the first position (shown in FIG. 1) to the second position (shown in FIGS. 3 and 4(*c*)) such that the capsules are burst and strained from the liquid 110 and thus moved away from the heating element 216. If the capsule shell fragments 222 are not moved away from the heating element, they may burn in use. As can be seen, the ridges on the first end 214 of the liquid transport element 212 enable liquid to be drawn into the end of the liquid transport element.

In use, the user activates the device, either by drawing on the mouthpiece which activates a puff sensor, or by a switch. The heating element 218 is then provided with power from the power supply 206, liquid in the capillary wick is vaporised by the heating element to form a supersaturated vapour. The vapour is then entrained in the airflow generated by the user drawing on the device, and forms an aerosol. Further liquid is drawn along the liquid transport 212 element by capillary action.

The outer housing 202 in the region of the cavity 210 may be substantially transparent to allow the user to view the contents of the cartridge 100.

An alternative example of a cartridge 500 is shown in FIG. 5(*a*). The cartridge 500 is similar to that shown in FIG. 1. The cartridge 500 again comprises a canister 502, lid 504 having an orifice 506, filter element 508, and liquid aerosol-forming substrate 510 comprising capsules 512 comprising a frangible shell encapsulating a second liquid aerosol-forming substrate. In this example the cartridge 500 comprises the liquid transport element 514 coupled to the filter element 508. The liquid transport element 514 may be the same as the liquid transport element 212 of device 200, or it may not be formed from a capillary wick. In the example, shown the liquid is transported by a tube 516 provided at the second end of the liquid transport element. The tube 516, shown in detail in FIG. 5(*b*), has a pair of inlets 518 in the shaft of the liquid transport element, and an outlet 520 at the second end of the liquid transport element. As will now be appreciated, in use, the liquid transport element is moved from the first position shown in FIG. 5(*a*) to a second position such that the pair of inlets for the tube 516 are within the canister and are able to transport liquid to an external heating element.

The cartridge may be used in a device 600 such as that shown in FIG. 6. The device is similar to that shown in FIG. 2, and comprises an outer housing 602, a mouthpiece 604, a power supply 606 and control electronic 608. The housing 602 comprises a cavity 610 for receiving a cartridge having an integral liquid transport element, such as cartridge 500 described above. The cavity is provided with a lid 612 configured to cover and close the cavity in use. The lid comprises a mechanism 614 for forcing the liquid transport element from the first position to the second position when the lid is closed by the user. The lid may be substantially transparent to enable the user to view the bursting and straining process as the lid is closed. The device 600 further comprises a heating element disposed in the cavity 610 for heating the liquid transported by the tube 516.

Once the lid is closed, the device 600 operates in the same manner as described above in relation to the device of FIG. 2.

FIG. 7 shows an alternative example of a cartridge 700. The cartridge 700 is similar to that shown in FIG. 1. The cartridge 700 again comprises a canister 702, lid 704 having an orifice 706, and liquid aerosol-forming substrate 708 comprising capsules 710 comprising a frangible shell encapsulating a second liquid aerosol-forming substrate. The capsules 710 are affixed to the inner surface of the sidewall 712 using adhesive. The sidewall 712 is flexible and, in use, the user exerts a compressive force to the canister 702 such that the sidewall 712 deforms and exerts a force on the capsules 710 so that they burst releasing the second liquid aerosol-forming substrate to mix with the liquid aerosol-forming substrate 708. The cartridge 700 may be used in a device shown in FIG. 2.

FIG. 8 shows an alternative example of a cartridge 800. The cartridge 800 is similar to that shown in FIG. 1. The cartridge 800 again comprises a canister 802, a lid 804 having an orifice 806, and a liquid aerosol-forming substrate 808 comprising capsules 112. The capsules 112 comprise a frangible shell encapsulating a second liquid aerosol-forming substrate. The capsules 112 are free to move within the liquid aerosol-forming substrate 808. The cartridge 800 further comprises a solid body 810 which is also free to move within the canister 802. When the user mechanically agitates the cartridge the solid body impacts the capsules 112 to cause them to burst and release the second liquid aerosol-forming substrate. The two liquids then mix, and the cartridge can be used in an aerosol-generating device. The cartridge 800 may be used in a device such as that shown in FIG. 2.

The invention claimed is:

1. A cartridge for an aerosol-generating system, the cartridge comprising:

a liquid storage container containing a first liquid composition and a second composition;

a plurality of capsules, each capsule encapsulating the second composition to separate the second composition from the first liquid composition, wherein each capsule comprises a frangible shell encapsulating the second composition;

a capsule retainer; and an outlet in the liquid storage container configured to deliver liquid from the liquid storage container, wherein the capsule retainer substantially prevents any frangible shells, or parts thereof, from exiting the cartridge through the outlet.

2. The cartridge according to claim 1, wherein the second composition is a liquid.

3. The cartridge according to claim 1, wherein the second composition is a liquid, and each capsule further comprises a porous element having the second liquid composition sorbed thereon.

4. The cartridge according to claim 1, further comprising at least two sets of capsules, the first set comprising the plurality of capsules encapsulating the second composition, and the second set comprising another plurality of capsules comprising a shell encapsulating a third composition.

5. The cartridge according to claim 1, further comprising a solid body freely movable within the liquid storage container.

6. The cartridge according to claim 1, wherein the liquid storage container comprises a flexible wall and the capsule retainer is an adhesive configured to adhere the capsules to at least one wall of the liquid storage container.

7. The cartridge according to claim 1, wherein the capsule retainer comprises a filter element.

8. The cartridge according to claim 7, wherein the filter element is movable between a first position adjacent the outlet to a second position remote from the first position.

9. The cartridge according to claim 8, further comprising a liquid transport element coupled to the filter element, the liquid transport element extending through the outlet.

10. The cartridge according to claim 1, wherein the first liquid composition comprises an aerosol-forming substrate.

11. An aerosol-generating system, comprising:

a cartridge comprising:

a liquid storage container containing a first liquid composition and a second composition, a plurality of capsules, each capsule encapsulating the second composition to separate the second composition from the first liquid composition, wherein each capsule comprises a frangible shell encapsulating the second composition, a capsule retainer, and an outlet in the liquid storage container configured to deliver liquid from the liquid storage container, wherein the capsule retainer substantially prevents any frangible shells, or parts thereof, from exiting the cartridge through the outlet; and a device configured to receive the cartridge, the device comprising:

a housing having a cavity configured to receive the cartridge, a liquid transport element comprising a first portion insertable into the outlet of the cartridge, and a second portion, a heating element adjacent the second portion of the liquid transport element, and a power supply configured to supply power to the heating element.

12. The aerosol-generating system according to claim 11, further comprising an actuator configured to engage the cartridge with the liquid transport element when the cartridge is received in the cavity.

13. The aerosol-generating system according to claim 11, further comprising a capsule rupturing device, the device being at least one of: an ultrasonic generator, an ultraviolet light, and a crusher.

* * * * *